US010631647B1

(12) United States Patent
Wu et al.

(10) Patent No.: US 10,631,647 B1
(45) Date of Patent: Apr. 28, 2020

(54) FOLDABLE HANGING CHAIR

(71) Applicant: Zhejiang Yotrio Group Co., Ltd., Linhai (CN)

(72) Inventors: Xiangyong Wu, Linhai (CN); Jianqiang Xie, Linhai (CN)

(73) Assignee: ZHEJIANG YOTRIO GROUP CO., LTD., Linhai (CN)

( * ) Notice: Subject to any disclaimer, the term of this patent is extended or adjusted under 35 U.S.C. 154(b) by 0 days.

(21) Appl. No.: 16/168,843

(22) Filed: Oct. 24, 2018

(51) Int. Cl.

| | |
|---|---|
| ***A63G 9/00*** | (2006.01) |
| ***A63G 9/12*** | (2006.01) |
| ***A45F 3/22*** | (2006.01) |
| ***A47C 4/18*** | (2006.01) |
| ***A47C 3/025*** | (2006.01) |
| ***A45F 3/26*** | (2006.01) |
| ***A45F 3/24*** | (2006.01) |

(52) U.S. Cl.
CPC ..... *A47C 4/18* (2013.01); *A45F 3/22* (2013.01); *A45F 3/24* (2013.01); *A45F 3/26* (2013.01); *A47C 3/0255* (2013.01); *A63G 9/00* (2013.01); *A63G 9/12* (2013.01)

(58) Field of Classification Search
CPC . A47C 4/18; A47C 3/0255; A45F 3/22; A45F 3/24; A45F 3/26
USPC ..... 297/16.1, 16.2, 277, 278, 279, 280, 281, 297/282
See application file for complete search history.

(56) References Cited

U.S. PATENT DOCUMENTS 268,783 A * 12/1882 Dodge ..... A45F 3/22 5/120
273,756 A * 3/1883 Moore ..... A45F 3/22 5/120
381,827 A * 4/1888 Broderick ..... A45F 3/22 5/121
445,049 A * 1/1891 Dicks ..... A45F 3/22 5/123
660,063 A * 10/1900 Nicholson ..... A45F 3/22 5/121
1,288,397 A * 12/1918 Eberle ..... A47D 13/105 297/280 X
1,317,106 A * 9/1919 Ross ..... A47C 3/0255 297/279
1,361,700 A * 12/1920 Elzey ..... A47C 3/0255 297/277 X
1,379,082 A * 5/1921 Cavanaugh ..... A47D 13/105 297/280 X (Continued)

*Primary Examiner* — Rodney B White
(74) *Attorney, Agent, or Firm* — Schwegman Lundberg & Woessner, P.A.

(57) ABSTRACT

A foldable hanging chair includes a frame; a base, foldably installed at a bottom of the frame; at least one support rod, foldably installed at one side of the frame; and flexible connection members, connecting the frame, the base, and the support rod together; wherein in an unfolded state, both the support rod and the base are at a certain angle to the frame, and the frame, the base, the support rod, and the flexible connection members enclose an accommodation space; and in a folded state, both the support rod and the base are close to one side of the frame. As both the base and the support rod are foldably installed at the frame, and at the same time, the flexible connection members connect the frame, the base, and the support rod together, the folding of the foldable hanging chair is not affected.

12 Claims, 5 Drawing Sheets

(56) References Cited

U.S. PATENT DOCUMENTS 1,515,263 A * 11/1924 Matsusaki ..... A45F 3/22 5/120
1,740,949 A * 12/1929 Luery ..... A47D 13/105 297/280 X
1,971,294 A * 8/1934 Bunker ..... A61G 7/1015 297/280 X
2,080,795 A * 5/1937 Stone ..... A47D 13/105 297/280 X
2,167,794 A * 8/1939 Bentz ..... A47D 13/105 297/277
2,443,786 A * 6/1948 Cooper ..... A47D 13/105 297/277
3,039,819 A * 6/1962 Williams ..... A47D 13/105 297/277
4,062,586 A * 12/1977 Ortize ..... A47C 3/0255 297/281 X
4,221,429 A * 9/1980 Wade ..... A45F 3/26 297/277 X
4,304,437 A * 12/1981 Longo ..... A63G 9/12 297/277
4,693,512 A * 9/1987 Hobson ..... A63G 9/00 297/277 X
4,838,609 A * 6/1989 Christensen ..... A47C 3/0255 297/277
4,886,143 A * 12/1989 Dubroc ..... A01M 31/02 182/142
5,113,537 A * 5/1992 Turk ..... A45F 3/22 135/90
5,851,053 A * 12/1998 Crawford ..... A47C 3/0255 297/280 X
5,944,381 A * 8/1999 Nguyen ..... A47D 13/105 297/281
6,019,427 A * 2/2000 Combest ..... B60P 3/36 297/277 X
6,623,081 B2 * 9/2003 Snyders ..... A47C 3/0255 297/280
6,854,801 B2 * 2/2005 Nussbaum ..... A47C 3/0255 297/279
6,913,314 B2 * 7/2005 Hansen ..... B60N 2/42 297/277 X
7,073,857 B1 * 7/2006 Bailey ..... A47C 3/0255 297/277 X
8,356,370 B1 * 1/2013 Clark ..... A45F 3/22 5/120
8,414,072 B2 * 4/2013 Phillips ..... A47C 1/14 297/277 X
8,616,639 B2 * 12/2013 Britz, Jr. ..... A63G 9/12 297/277 X
8,801,099 B2 * 8/2014 Ebel ..... B60N 2/24 297/277
9,095,204 B2 * 8/2015 Ou ..... A45F 3/22
9,468,284 B2 * 10/2016 Wehner ..... A45F 3/26
9,776,576 B1 * 10/2017 McDermott ..... B60R 11/00
9,861,181 B2 * 1/2018 Wehner ..... A45F 3/26
10,016,048 B2 * 7/2018 Wehner ..... A45F 3/26
10,398,214 B2 * 9/2019 Wehner ..... A45F 3/26
2003/0140417 A1 * 7/2003 Huff ..... A45F 3/22 5/120
2006/0061165 A1 * 3/2006 Molen ..... A47C 3/0255 297/273
2008/0203774 A1 * 8/2008 Hemetsberger ..... A47C 1/14 297/16.2
2012/0080916 A1 * 4/2012 Stringer ..... A01M 31/025 297/217.1
2013/0175836 A1 * 7/2013 Chen ..... A47C 1/0342 297/273
2019/0167006 A1 * 6/2019 Sabbagh ..... A47C 5/02

* cited by examiner

FOLDABLE HANGING CHAIR

BACKGROUND OF THE INVENTION

Field of the Invention

This invention relates to a technical field of furniture and, more particularly, to a foldable hanging chair.

Description of the Related Art

With the improvement of living standards, products like a hanging chair are more and more popular among consumers. However, the shape of the conventional products like the hanging chair is fixed, the conventional products of the hanging chair cannot be folded, and the packaging is large. Therefore, it is difficult to transport the conventional hanging chair, and the cost is high, which greatly limits the popularity of such products.

BRIEF SUMMARY OF THE INVENTION

Aiming at the above-mentioned problems, this invention overcomes at least one deficiency and provides a foldable hanging chair.

A technical solution of this invention is as follows: A foldable hanging chair includes:

a frame;

a base, foldably installed at a bottom of the frame;

at least one support rod, foldably installed at one side of the frame; and flexible connection members, connecting the frame, the base, and the support rod together;

wherein in an unfolded state, both the support rod and the base are at a certain angle to the frame, and the frame, the base, the support rod, and the flexible connection members enclose an accommodation space; and in a folded state, both the support rod and the base are close to one side of the frame.

In one embodiment of this invention, both the base and the support rod may be foldably installed at the frame through a folding structure.

In one embodiment of this invention, the folding structure may include a first connection member, a second connection member, and a third connection member. The first connection member may be fixedly connected with the frame, the second connection member may be fixedly connected with the base or the support rod, and the third connection member may be connected with the first connection member and the second connection member, such that the second connection member is capable of being rotated relative to the first connection member.

In one embodiment of this invention, the third connection member may include a stud and a nut, one end of the stud may be fixedly connected with the second connection member, and the other end of the stud may pass through the first connection member to be connected with the nut through thread cooperation.

In one embodiment of this invention, the third connection member may include a first rivet and a second rivet, and the first rivet may pass through the first connection member and the second connection member to be connected with the second rivet.

In one embodiment of this invention, the third connection member may include a screw and a nut. One end of the screw may abut against one side of the first connection member or one side of the second connection member, and the other end may pass through the first connection member and the second connection member to be connected with the nut through thread cooperation.

In one embodiment of this invention, the frame may be in an arch-shape.

In one embodiment of this invention, the base may include a bottom frame and grills connected inside the bottom frame.

In one embodiment of this invention, the bottom frame may be made of metal, and the grills may be made of rattan, a woven band, a plastic rope, or a steel wire.

In one embodiment of this invention, both the frame and the support rod may be made of metal.

In one embodiment of this invention, the flexible connection members may be made of a woven band, rattan, a plastic rope, a steel wire, a strip of cloth, or a piece of cloth.

Compared with the prior art, this invention has beneficial effects that as both the base and the support rod can be foldably installed at the frame, and the flexible connection members connect the frame, the base, and the support rod together at the same time, the folding of the foldable hanging chair is not affected. After the foldable hanging chair is folded, both the support rod and the base are close to one side of the frame, and the volume is greatly reduced, which is convenient for packaging, transportation, and storage, greatly reduces the cost of the packaging and the transportation, and is popular for popularization.

DETAILED DESCRIPTION OF THE INVENTION

This invention will be described in detail below with reference to the accompanying drawings.

Please refer to FIG. 1 to FIG. 4. This invention provides a foldable hanging chair, including: a frame 1, a base 2, at least one support rod 3, and flexible connection members 4. The base 2 is foldably installed at a bottom of the frame 1. The support rod 3 is foldably installed at one side of the frame 1. The flexible connection members 4 connect the frame 1, the base 2, and the support rod 3 together.

Figure 1:
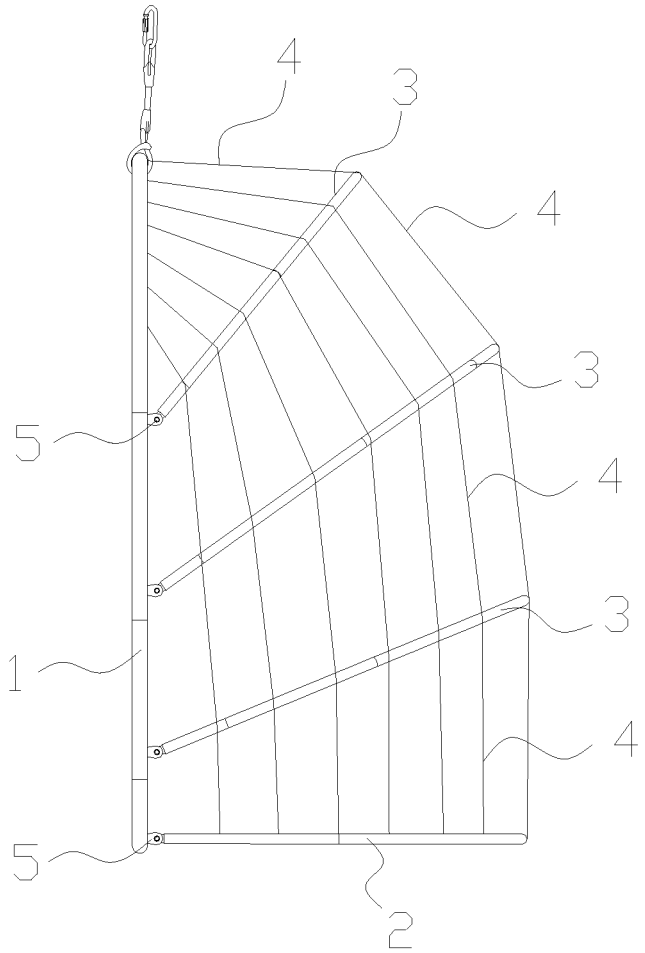
FIG. 1 is a structural schematic diagram of a foldable hanging chair in an unfolded state according to one embodiment of this invention.
Figure 2:
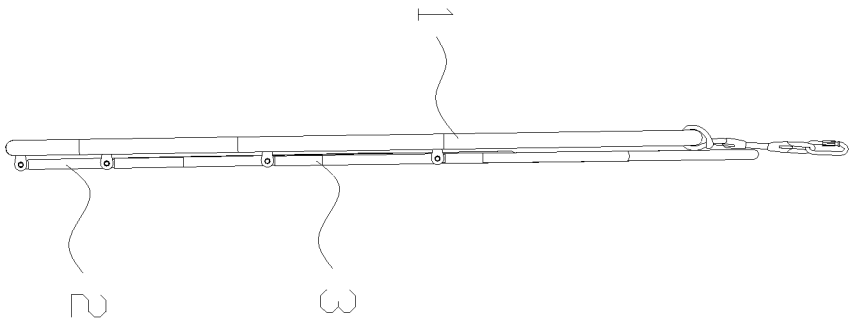
FIG. 2 is a structural schematic diagram of the foldable hanging chair in a folded state according to one embodiment of this invention.
Figure 3:
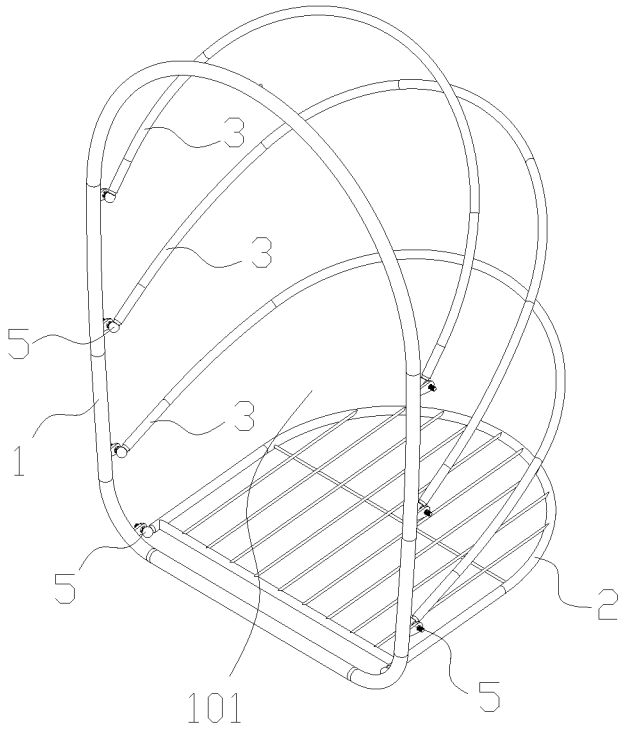
FIG. 3 is a perspective view of the foldable hanging chair according to one embodiment this invention, not showing flexible connection members.
Figure 4:
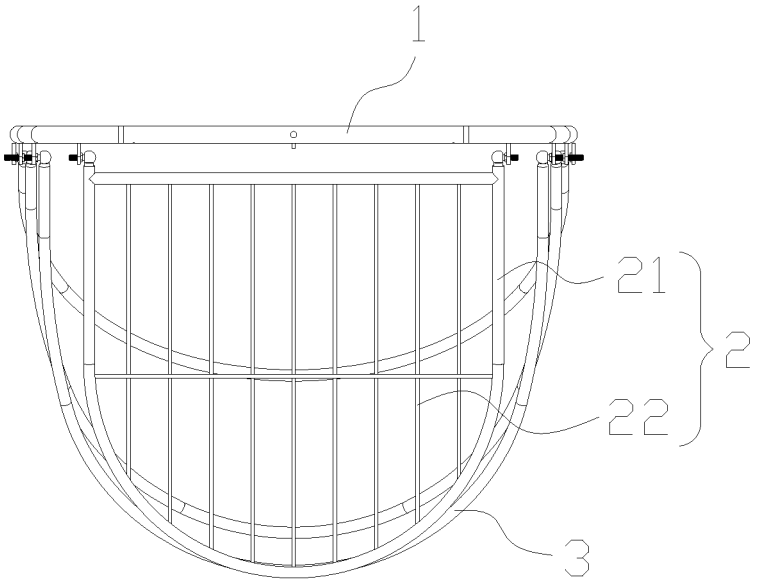
FIG. 4 is a top view of the foldable hanging chair according to one embodiment of this invention.

As shown in FIG. 1, in an unfolded state, both the support rod 3 and the base 2 are at a certain angle to the frame 1, and the frame 1, the base 2, the support rod 3, and the flexible connection members 4 enclose an accommodation space 101 for people to sit. As shown in FIG. 2, in a folded state, both the support rod 3 and the base 2 are close to one side of the frame 1.

As the flexible connection members 4 connect the frame 1, the base 2, and the support rod 3 together, the folding of the foldable hanging chair is not affected. After the foldable hanging chair is folded, both the support rod 3 and the base 2 are close to one side of the frame 1, and the volume is greatly reduced, which is convenient for packaging, transportation, and storage, greatly reduces the cost of the packaging and the transportation, and is popular for popularization. It should be noted that "both the support rod 3 and the base 2 are close to one side of the frame 1" can be understood as the support rod 3 and the base 2 are close to the same side of the frame 1, and it can also be understood that the support rod 3 and the base 2 are close to two sides of the frame 1, respectively. This invention is not limited thereto.

Both the base 2 and the support rod 3 are foldably installed at the frame 1 through folding structures 5. The folding structure 5 connected with the base 2 and the folding structure 5 connected with the support rod 3 may be the same or different.

Figure 5:
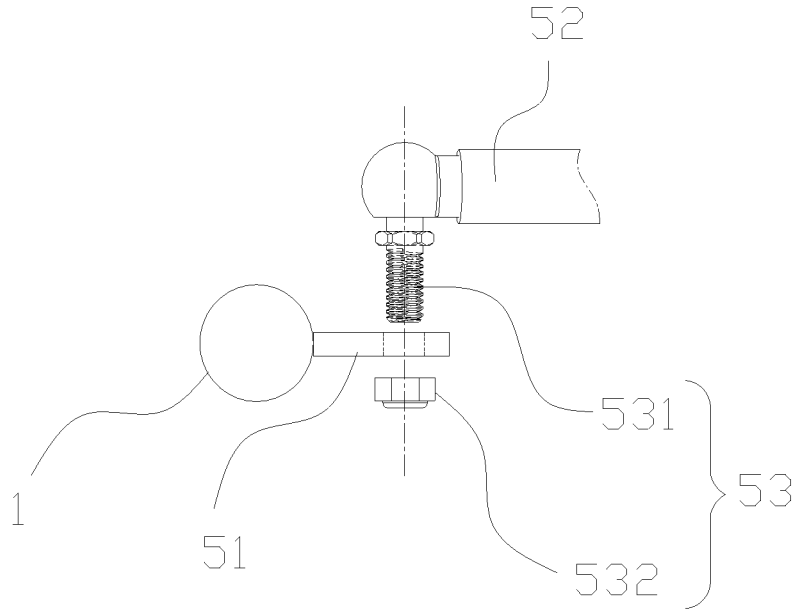
FIG. 5 is a structural schematic diagram of a folding structure of the foldable hanging chair according to the first embodiment of this invention.
Figure 6:
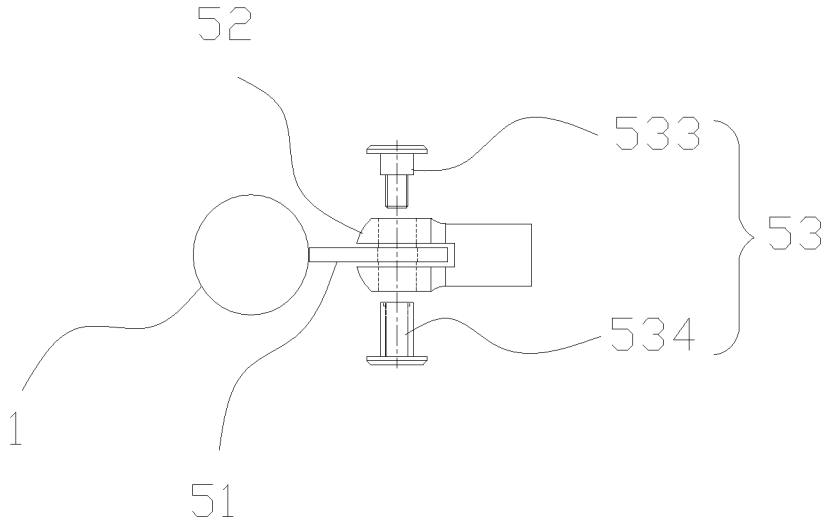
FIG. 6 is a structural schematic diagram of a folding structure of the foldable hanging chair according to the second embodiment of this invention.
Figure 7:
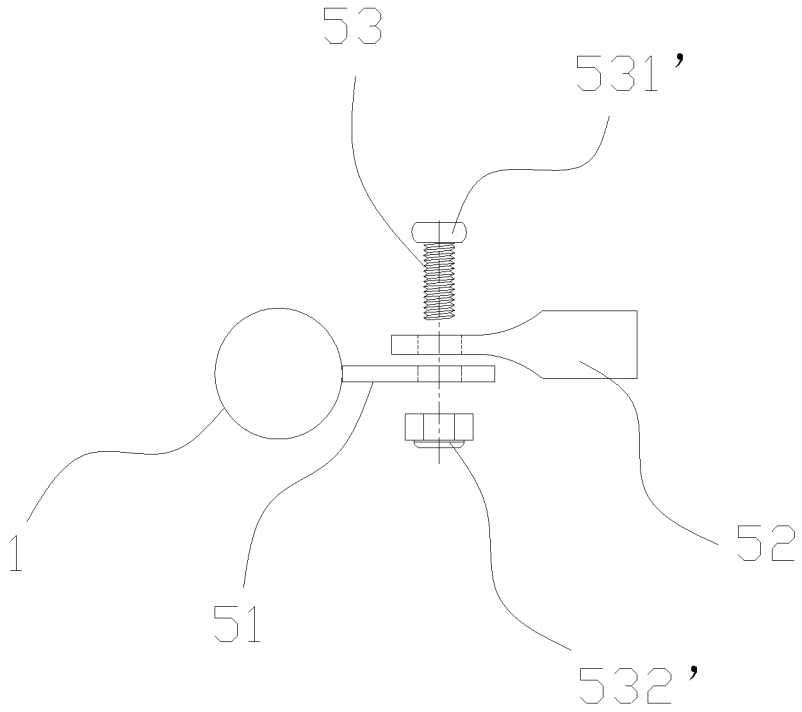
FIG. 7 is a structural schematic diagram of a folding structure of the foldable hanging chair according to the third embodiment of this invention.

Please refer to FIG. 5 to FIG. 7, the folding structure 5 includes a first connection member 51, a second connection member 52, and a third connection member 53. The first connection member 51 is fixedly connected with the frame 1, the second connection member 52 is fixedly connected with the base 2 or the support rod 3, and the third connection member 53 is connected with the first connection member 51 and the second connection member 52, such that the second connection member 52 is capable of being rotated relative to the first connection member 51. The folding structure 5 is very simple and flexible to use.

Further, the first connection member 51 may be a sheet-like structure welded at the frame 1. The second connection member 52 may have a plurality of shapes. As shown in the figure, the second connection member 52 has a spherical end; as shown in the figure, the second connection member 52 has two clamping arms to clamp the first connection member 51; and as shown in the figure, the end of the second connection member 52 is sheet-shaped. The shape of the second connection member 52 can be changed according to installation requirements, and the shape of the second connecting member 52 is not limited by this invention.

The third connection member 53 may have a plurality of embodiments. In the first embodiment, please refer to FIG. 5. The third connection member 53 includes a stud 531 and a nut 532, one end of the stud 531 is fixedly connected with the second connection member 52, and the other end of the stud 531 passes through the first connection member 51 and is connected with the nut 532 through thread cooperation. However, in another variant embodiment, the stud 531 may also be fixedly connected with the first connection member 51, and the other end of the stud 531 passes through the second connection member 52 and is connected with the nut 532 through the thread cooperation.

In the second embodiment, please refer to the figure. The third connection member 53 includes a first rivet 533 and a second rivet 534, and the first rivet 533 passes through the first connection member 51 and the second connection member 52 and is riveting with the second rivet 534.

In the third embodiment, please refer to the figure. The third connection member 53 includes a screw 531' and a nut 532', one end of the screw 531' abuts against one side of the first connection member 51 or one side of the second connection member 52, and the other end passes through the first connection member 51 and the second connection member 52 and is connected with the nut 532' through the thread cooperation.

The third connection members 53 of the embodiments shown in the figures can realize the flexible rotation of the second connection members 52 relative to the first connection members 51, such that the folding and unfolding of the base 2 or the support rod 3 can be easily realized. When the foldable hanging chair is hung, due to the gravity of the base 2 and the support rod 3, the base 2 and the support rod 3 will drive the second connection member 52 to rotate relative to the first connection member 51, such that the foldable hanging chair can be automatically unfolded without any assembly, which is very convenient. Moreover, the structures of the three embodiments are very simple and easy to install, and connections are firm.

The frame 1 is in an arch-shape. The appearance is beautiful, and sharp corners are avoided, which avoids bumping people, and the structure is stable.

The support rod 3 is bent into an arc-shape. The appearance is beautiful, and sharp corners are avoided, which avoids bumping people, and the structure is stable.

The number of the support rods 3 may be multiple and is selected according to the size of the hanging chair. In one embodiment, the number of the support rods 3 is three, and the three support rods 3 are arranged along the height direction of the frame 1. Angles between the three support rods 3 and the frame 1 increase from top to bottom. Such structure is advantageous for forming a nest-shaped accommodation space 101, which is beautiful in appearance.

The base 2 includes a bottom frame 21 and grills 22 connected inside the bottom frame 21. The base is breathable, and the overall weight is light, which is convenient for transportation and use.

The bottom frame 21 may be made of metal, for example, iron or steel, and the structure is stable. The grills 22 may be made of rattan, a woven band, a plastic rope or a steel wire, and it is comfortable to use.

The frame 1 and the support rod 3 may be made of metal, for example, iron or steel, and the structures are stable.

The flexible connection member 4 is a woven band, rattan, a plastic rope, a steel wire, a strip of cloth or a piece of cloth, and the material is cheap and practical.

The above-mentioned are only preferred embodiments of this invention, and thus do not limit the protection scope of this invention. Any equivalent structural transformation made by using the specification and the drawings of this invention and directly or indirectly applied to other related technical field is equally included in the protection scope of this invention.

What is claimed is:

1. A foldable hanging chair, comprising:

a frame;

a base, foldably installed at a bottom of the frame;

at least one support rod, foldably installed at one side of the frame; and flexible connection members, connecting the frame, the base, and the support rod together;

wherein in an unfolded state, both the support rod and the base are at a certain angle to the frame, and the frame, the base, the support rod, and the flexible connection members enclose an accommodation space; and in a folded state, both the support rod and the base are close to one side of the frame;

wherein both the base and the support rod are foldably installed at the frame through a folding structure;

wherein the folding structure comprises a first connection member, a second connection member, and a third connection member, the first connection member is fixedly connected with the frame, the second connection member is fixedly connected with the base or the support rod, and the third connection member is connected with the first connection member and the second connection member, such that the second connection member is capable of being rotated relative to the first connection member.

2. The foldable hanging chair according to claim 1, wherein the third connection member comprises a stud and a nut, one end of the stud is fixedly connected with the second connection member, and the other end of the stud passes through the first connection member and is connected with the nut through thread cooperation.

3. The foldable hanging chair according to claim 1, wherein the third connection member comprises a first rivet and a second rivet, and the first rivet passes through the first connection member and the second connection member and is connected with the second rivet.

4. The foldable hanging chair according to claim 1, wherein the third connection member comprises a screw and a nut, one end of the screw abuts against one side of the first connection member or one side of the second connection member, and the other end passes through the first connection member and the second connection member and is connected with the nut through thread cooperation.

5. The foldable hanging chair according to claim 1, wherein the frame is in an archshape.

6. The foldable hanging chair according to claim 1, wherein the support rod is bent into an arc-shape.

7. The foldable hanging chair according to claim 1, wherein the base comprises a bottom frame and grills connected inside the bottom frame.

8. The foldable hanging chair according to claim 7, wherein the bottom frame is made of metal, and the grills are made of rattan, a woven band, a plastic rope, or a steel wire.

9. The foldable hanging chair according to claim 1, wherein both the frame and the support rod are made of metal.

10. The foldable hanging chair according to claim 1, wherein the flexible connection members are made of a woven band, rattan, a plastic rope, a steel wire, a strip of cloth, or a piece of cloth.

11. A foldable hanging chair, comprising:

a frame;

a base, foldably installed at a bottom of the frame;

at least one support rod, foldably installed at one side of the frame; and flexible connection members, connecting the frame, the base, and the support rod together;

wherein in an unfolded state, both the support rod and the base are at a certain angle to the frame, and the frame, the base, the support rod, and the flexible connection members enclose an accommodation space; and in a folded state, both the support rod and the base are close to one side of the frame;

wherein the base comprises a bottom frame and grills connected inside the bottom frame.

12. The foldable hanging chair according to claim 11, wherein the bottom frame is made of metal, and the grills are made of rattan, a woven band, a plastic rope, or a steel wire.

* * * * *